US008935947B2

(12) United States Patent
Yoo

(10) Patent No.: US 8,935,947 B2
(45) Date of Patent: Jan. 20, 2015

(54) APPARATUS FOR MANUFACTURING NECKING CANS

(75) Inventor: Il Han Yoo, Seoul (KR)

(73) Assignee: Paseco Co., Ltd. (KR)

( * ) Notice: Subject to any disclaimer, the term of this patent is extended or adjusted under 35 U.S.C. 154(b) by 364 days.

(21) Appl. No.: 13/502,644

(22) PCT Filed: Oct. 8, 2010

(86) PCT No.: PCT/KR2010/006899

§ 371 (c)(1),
(2), (4) Date: Apr. 18, 2012

(87) PCT Pub. No.: WO2011/049308

PCT Pub. Date: Apr. 28, 2011

(65) Prior Publication Data

US 2012/0198905 A1 Aug. 9, 2012

(30) Foreign Application Priority Data

Oct. 20, 2009 (KR) ..... 10-2009-0099640

(51) Int. Cl.
*B21D 22/00* (2006.01)
*B21D 51/26* (2006.01)
(Continued)

(52) U.S. Cl.
CPC ..... *B21D 51/38* (2013.01); *B21D 22/14* (2013.01); *B21D 41/04* (2013.01); *B21D 51/26* (2013.01); *B21D 51/2638* (2013.01)
USPC ..... 72/405.01; 72/405.07; 72/348

(58) Field of Classification Search
USPC ..... 72/347, 348, 405.01, 405.07; 413/69, 413/73, 76; 198/345.1, 345.2, 621.1, 621.2
See application file for complete search history.

(56) References Cited

U.S. PATENT DOCUMENTS 1,705,843 A 3/1929 George
1,912,258 A 5/1933 Coyle
(Continued)

FOREIGN PATENT DOCUMENTS

CN 102574193 7/2012
JP 03-30808530 5/1993
(Continued)

OTHER PUBLICATIONS

International Preliminary Report on Patentability issued Apr. 24, 2012 by the International Bureau on behalf of the International Searching Authority for application PCT/KR2010/006899 filed Aug. 10, 2010 (Applicant—Paseco Co., Ltd // Inventor—Yoo) (7 pages).
(Continued)

*Primary Examiner* — Debra Sullivan
(74) *Attorney, Agent, or Firm* — Ballard Spahr, LLP

(57) ABSTRACT

According to the present invention, an apparatus for manufacturing necking cans processes inlets of cans for which drawing processes are completed, wherein the apparatus comprises: a lower press plate; an upper press plate arranged so as to move linearly in the upward and downward directions relative to the lower press plate; a molding unit including a guide formed on the lower press plate, a plurality of holders arranged on the guide such that the holders can be transferred, and a plurality of molds arranged on the upper press plate; transferring means for transferring the holders along the guide; and driving means for driving the upper press plate. The apparatus of the present invention is advantageous in that cans for which the drawing processes are completed are linearly transferred by a plurality of cylinders and processed at a high speed.

9 Claims, 7 Drawing Sheets

(51) Int. Cl.

| | |
|---|---|
| ***B21D 51/38*** | (2006.01) |
| ***B21D 22/14*** | (2006.01) |
| ***B21D 41/04*** | (2006.01) |

(56) References Cited

U.S. PATENT DOCUMENTS

| | | | | | |
|---|---|---|---|---|---|
| 4,070,888 | A | | 1/1978 | Gombas | |
| 4,096,731 | A | * | 6/1978 | Uehlinger et al. | 72/405.07 |
| 4,176,536 | A | | 12/1979 | Panknin | |
| 4,207,761 | A | | 6/1980 | Niemi | |
| 4,308,737 | A | | 1/1982 | Kannegiesser | |
| 4,747,287 | A | | 5/1988 | Azzaline | |
| 5,899,109 | A | * | 5/1999 | Fisch | 72/405.16 |
| 8,037,728 | B2 | | 10/2011 | Hosoi | |
| 2007/0240479 | A1 | * | 10/2007 | Nagai et al. | 72/348 |

FOREIGN PATENT DOCUMENTS

| | | |
|---|---|---|
| JP | 11-159540 | 6/1999 |
| JP | 2004-298881 | 10/2004 |
| JP | 2007-229807 | 9/2007 |
| JP | 2006-220314 | 2/2008 |
| JP | 5439600 | 3/2014 |
| KR | 10-1999-0076989 | 10/1999 |
| KR | 10-2001-0074339 | 6/2003 |
| KR | 10-2009-0076185 | 7/2009 |
| KR | 10-2009-0099640 | 8/2011 |
| WO | PCT/US1997/020049 | 5/1998 |
| WO | PCT/KR2010/006899 | 4/2011 |
| WO | 2011-093601 | 8/2011 |

OTHER PUBLICATIONS

International Search Report issued Jun. 16, 2011 by the International Searching Authority for application PCT/KR2010/006899 filed Aug. 10, 2010 (Applicant—Paseco Co., Ltd // Inventor—Yoo) (2 pages).

Written Opinion issued Jun. 16, 2011 by the International Searching Authority for application PCT/KR2010/006899 filed Aug. 10, 2010 (Applicant—Paseco Co., Ltd // Inventor—Yoo) (6 pages).

International Search Report and Written Opinion issued Sep. 7, 2011 for International Patent Application No. PCT/KR2011/000149, which was filed on Jan. 11, 2011 and published as WO 2011/093601 on Aug. 4, 2011 (Inventor—Yoo; Applicant—Paseco Co., Ltd.) (pp. 1-10).

International Preliminary Report on Patentability issued Aug. 7, 2012 for International Patent Application No. PCT/KR2011/000149, which was filed on Jan. 11, 2011 and published as WO 2011/093601 on Aug. 4, 2011 (Inventor—Yoo; Applicant—Paseco Co., Ltd.) (pp. 1-9).

International Preliminary Report on Patentability issued Apr. 24, 2012 for International Patent Application No. PCT/KR2010/006899, which was filed on Oct. 8, 2010 and published as WO 2011/049308 on Apr. 28, 2011 (Inventor—Yoo; Applicant—Paseco Co., Ltd.) (pp. 1-5).

International Search Report and Written Opinion issued Jun. 16, 2011 for International Patent Application No. PCT/KR2010/006899, which was filed on Oct. 8, 2010 and published as WO 2011/049308 on Apr. 28, 2011 (Inventor—Yoo; Applicant—Paseco Co., Ltd.) (pp. 1-5).

* cited by examiner

Prior Art (a)

APPARATUS FOR MANUFACTURING NECKING CANS

CROSS REFERENCE TO RELATED APPLICATIONS

The present application is a National Phase Application of International Application No. PCT/KR2010/006899, filed Oct. 8, 2010, which claims the benefit of Korean Patent Applications No. 10-2009-0099640, filed Oct. 20, 2009, which applications are incorporated herein fully by this reference.

TECHNICAL FIELD

The present invention relates to an apparatus for manufacturing necking cans and, more particular, to an apparatus for manufacturing necking cans, which processes the entrance of each metal can for which a drawing process is completed (i.e., a cylindrical body with a bottom).

BACKGROUND ART

In general, a metal can used as a storage container of beverage is mainly made of aluminum or iron.

The metal can is formed by performing a drawing process, an ironing process, etc. on an aluminum plate or an iron plate in multiple stages.

Moreover, the metal can is divided into an easy open end can and a can provided with a bottleneck, and the metal can provided with a bottleneck is called a necking can, bottle can, neck-in can, etc. (hereinafter, referred to as "necking can").

The necking can is subjected to a neck-in process to reduce the entrance and form a screw thread such that a cap is connected to the entrance (see FIG. 1).

Next, a conventional apparatus for manufacturing necking cans will be described with reference to FIG. 2.

As shown in FIG. 2, a conventional apparatus 10 for manufacturing necking cans comprises an upper press plate 11 which moves linearly up and down and a lower press plate 12 which rotates to transfer the can to the next process.

Moreover, a plurality of molds 13 are provided on the upper press plate 11 to gradually reduce the entrance of each can for which the drawing process is completed, and a plurality of holders 14 into which the cans are inserted are provided on the lower press plate 12.

Furthermore, a circular guide 15 is provided on the lower press plate 12 such that the holders are mounted thereon.

Meanwhile, the lower press plate 12 is rotated by the driving force of a motor 16.

Accordingly, in the conventional apparatus 10 for manufacturing necking cans, the mold 13 gradually reduces the entrance of the can by the up-and-down linear motion of the upper press plate 11, and the lower press plate 12 rotates to transfer the can fixed in the holder 14 to the next process (i.e., to the next mold).

As such, the entrance processing and the transfer operation are continuously performed such that the cylindrical can is formed into a bottle shape while its entrance is gradually reduced, and the can formed into a bottle shape has a screw thread formed on the top of the can, on which a cap is sealed, by a sealing lip mold as shown in (c) of FIG. 1 and has a curled end as shown in (d) of FIG. 1, thereby completing a necking can.

However, according to the conventional apparatus 10 for manufacturing necking cans, the cans are transferred in a rotating manner, and thus the holders 14 are shaken by inertia, which is very problematic.

In order to prevent the holders 14 from being shaken, the rotational transfer speed of the lower press plate 12 may be limited or a soft strengthening material (such as leather or synthetic resin) may be disposed between the holder 14 and the guide 15. However, this results in loss of productivity and replacement of the strengthening material due to wear, which requires a lot of supplies.

Moreover, according to the conventional apparatus 10 for manufacturing necking cans, the plurality of molds 13 and holders 14 should be replaced and set one by one, and thus it is very inconvenient to process necking cans of various sizes.

In addition, as the replacement time of the molds 13 and the holder 14 increases, the productivity is reduced.

DISCLOSURE

Technical Problem

Accordingly, the present invention has been made to solve the above-described problems, and an object of the present invention is to provide an apparatus for manufacturing necking cans, which can process cans at high speed by linearly transferring the cans for which a drawing process is completed.

Another object of the present invention is to provide an apparatus for manufacturing necking cans, which can facilitate replacement of molds and holders.

Still another object of the present invention is to provide an apparatus for manufacturing necking cans, which comprises a plurality of molding units to manufacture the necking cans at high speed and to process necking cans having different sizes at the same time.

Technical Solution

To accomplish the above objects of the present invention, there is provided an apparatus for manufacturing necking cans, which processes the entrance of each can for which a drawing process is completed, the apparatus comprising: a lower press plate; an upper press plate provided to move linearly up and down with respect to the lower press plate; a molding unit including a guide formed on the lower press plate, a plurality of holders provided on the guide to be transferred, and a plurality of molds provided on the upper press plate; a transfer means for transferring the holders along the guide; and a drive means for driving the upper press plate.

Preferably, the guide may comprise first and second guides divided by a guide frame attached to the lower press plate, and both ends of the first and second guides may be connected to each other such that the holders circulate.

Preferably, the transfer means may comprise a first cylinder for transferring the holders along the first guide, a second cylinder for transferring the holders along the second guide, and third and fourth cylinders for transferring the holders located at both ends of the first and second guides.

Preferably, each of the first to fourth cylinders may comprise a push block.

Preferably, the drive means may comprise a motor for generating driving force, a drive shaft for transmitting the driving force of the motor, a drive cam axially connected to the drive shaft, and a driven body for moving the upper press plate linearly up and down in conjunction with the drive cam.

Preferably, the apparatus may further comprise a holder supporting means for supporting the holders.

Preferably, the holder supporting means may comprise a support plate connected to the lower press plate by a horizontal support and moved horizontally toward the holders, a holder driven body provided on the support plate and including a bearing, and a holder transfer cam fixed on the upper press plate and including a taper groove, through which the bearing is inserted, and a straight groove.

Preferably, the support plate may comprise a semicircular support groove corresponding to the holder.

Preferably, the apparatus may further comprise a mold pocket, in which the molds are provided, and the mold pocket may be mounted on the upper press plate by a mold pocket pin.

Preferably, the mold may comprise an outer mold and an inner mold and may be mounted in the mold pocket by height adjusting nut and bolt.

Preferably, the molding unit may comprise first and second molding units to separately process the cans for which the drawing process is completed.

Advantageous Effects

According to the apparatus for manufacturing necking cans in accordance with the present invention, the cans for which the drawing process is completed can be moved linearly by the plurality of cylinders and processed at high speed.

Moreover, the support plate supports the holders, by which the cans are fixed, in conjunction with the down movement of the molds, thus preventing the holders from moving.

Furthermore, the mold pocket, in which the plurality of molds are mounted, and the holders can be rapidly replaced, thus improving the productivity.

In addition, the first and second molding units can separately process the cans at high speed, which ensures high productivity. Moreover, two types of products can be manufactured by a single equipment by separately mounting molds having different sizes on the first and second molding units as occasion demands, thus maximizing the efficiency of managing the equipment.

That is, it is possible to manufacture cans having different sizes at the same time.

MODE FOR INVENTION

Hereinafter, preferred embodiments of the present invention will be described in is detail with reference to the accompanying drawings.

Figure 1:
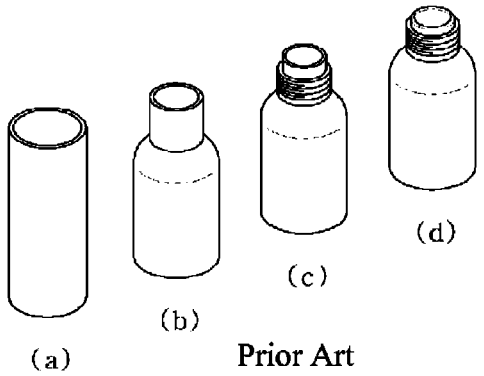
FIG. 1 is a diagram showing a molding sequence of a typical necking can.
Figure 2:
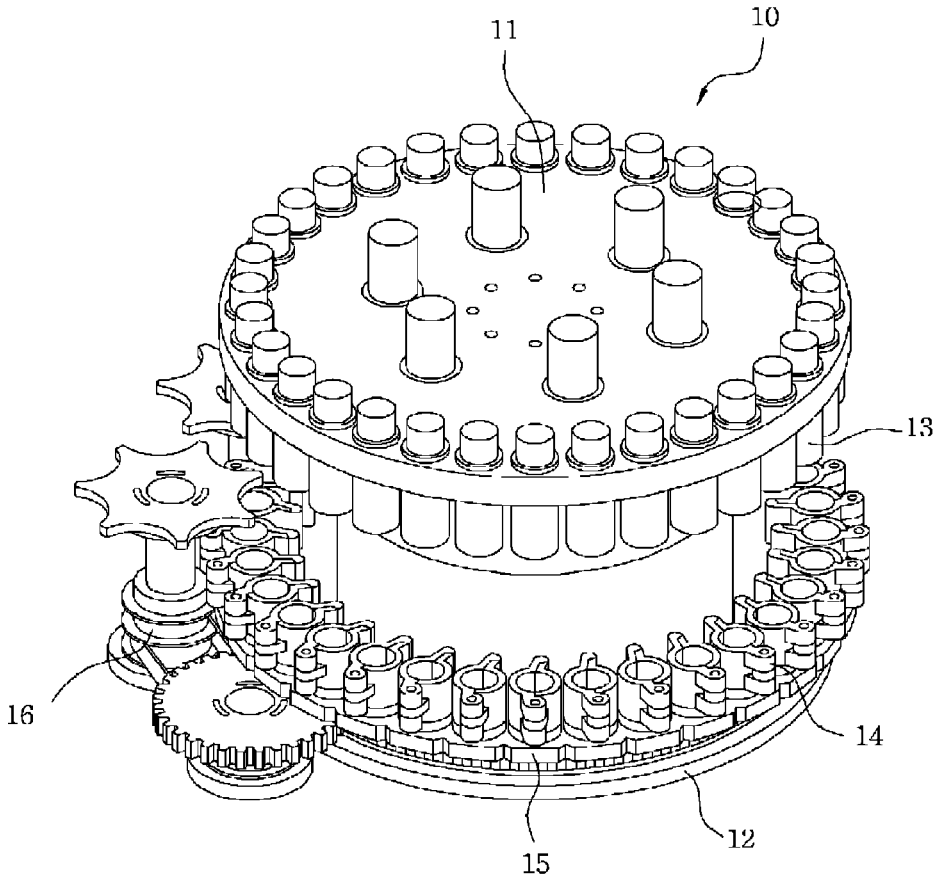
Prior Art Fig. 2
FIG. 2 is a perspective view showing a conventional apparatus for manufacturing necking cans.
Figure 3:
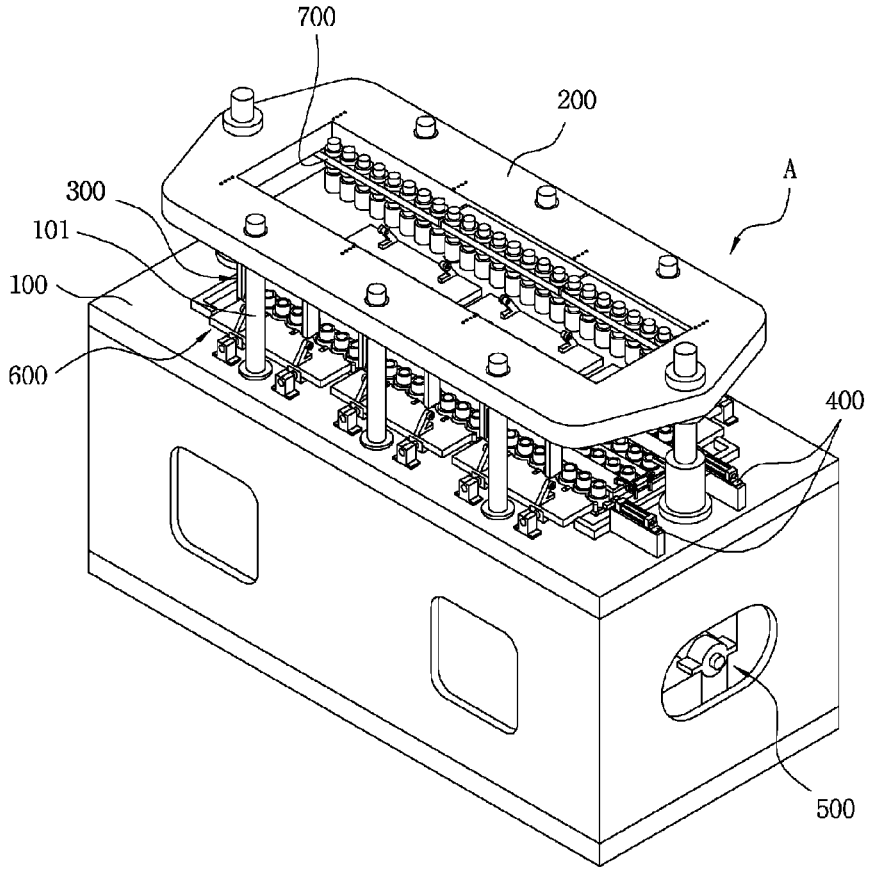
FIG. 3 is a perspective view showing an apparatus for manufacturing necking cans in accordance with the present invention.
Figure 4:
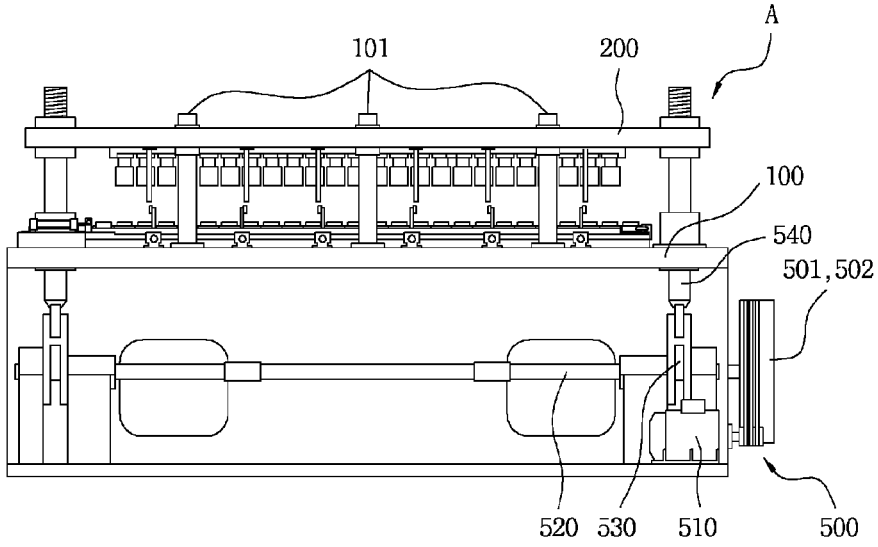
FIG. 4 is a side view of FIG. 3.
Figure 5:
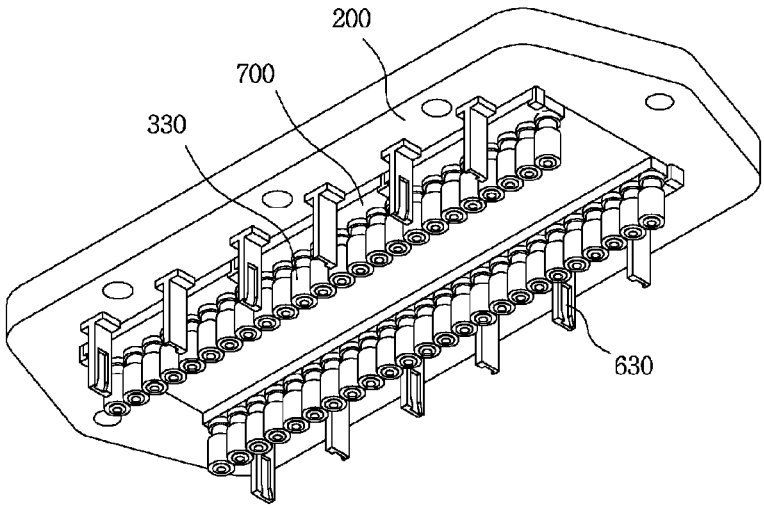
FIG. 5 is a perspective view showing an upper press plate of FIG. 3.
Figure 6:
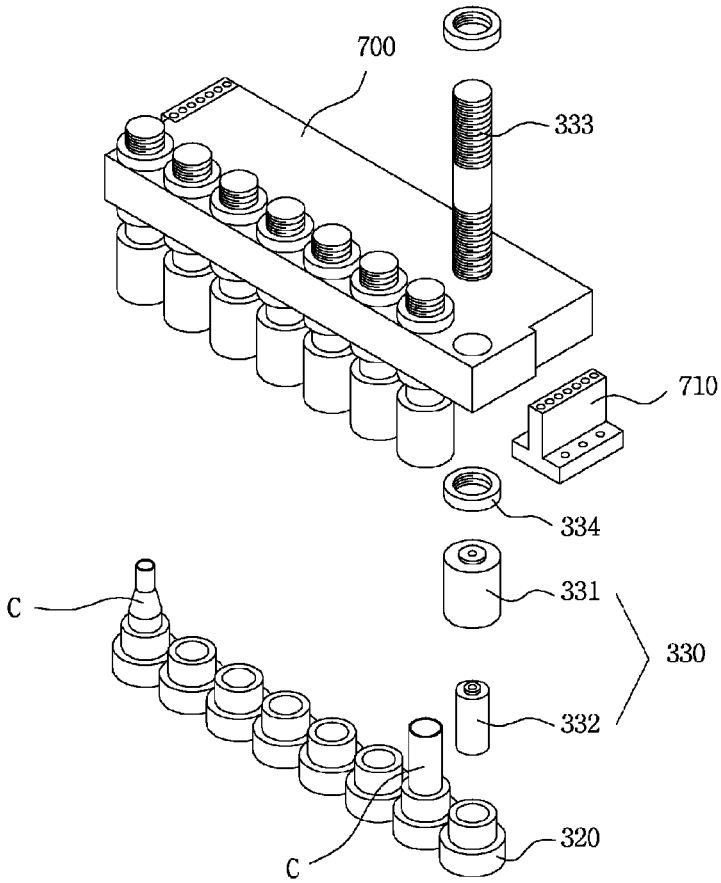
FIG. 6 is a perspective view showing a mold pocket of FIG. 3.
Figure 7:
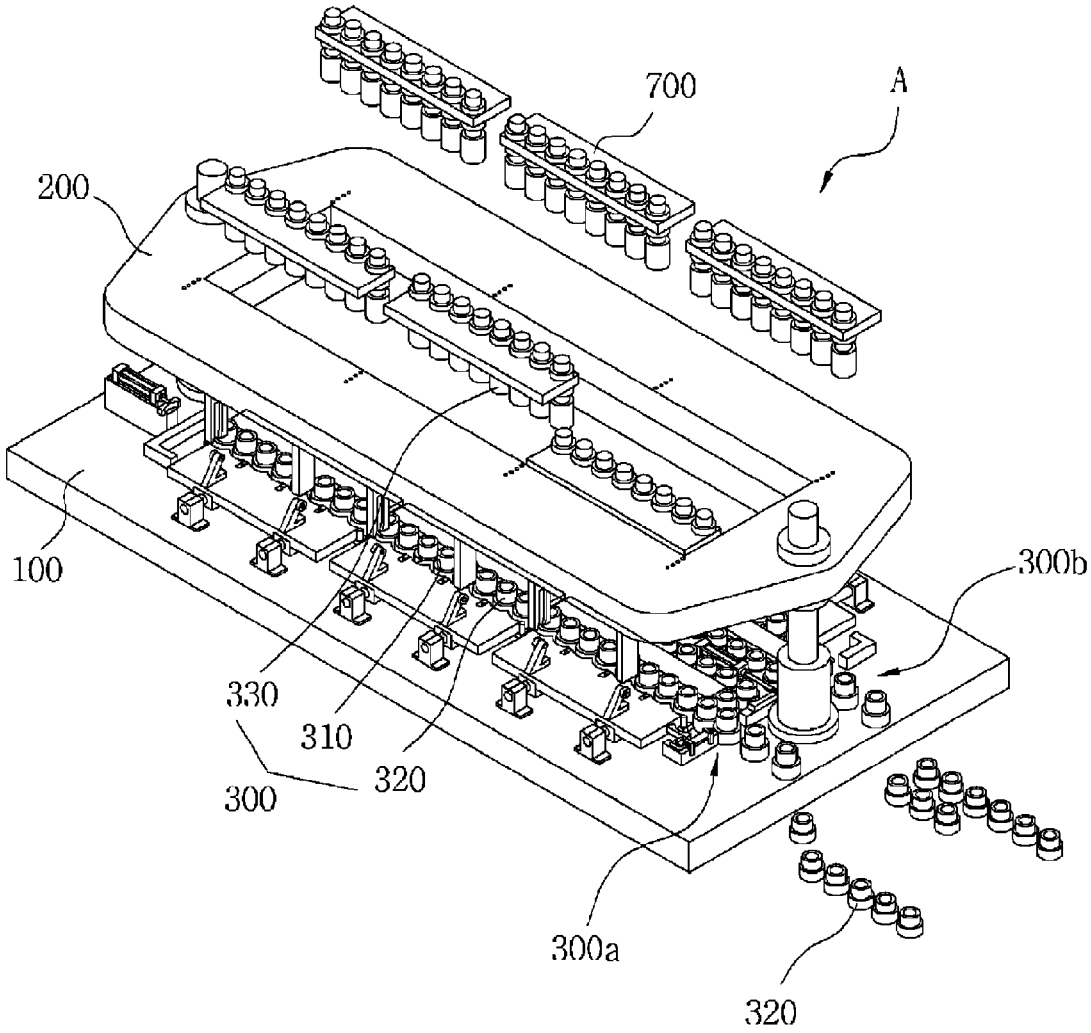
FIG. 7 is a perspective view showing the installation state of the mold pocket of FIG. 6.
Figure 8:
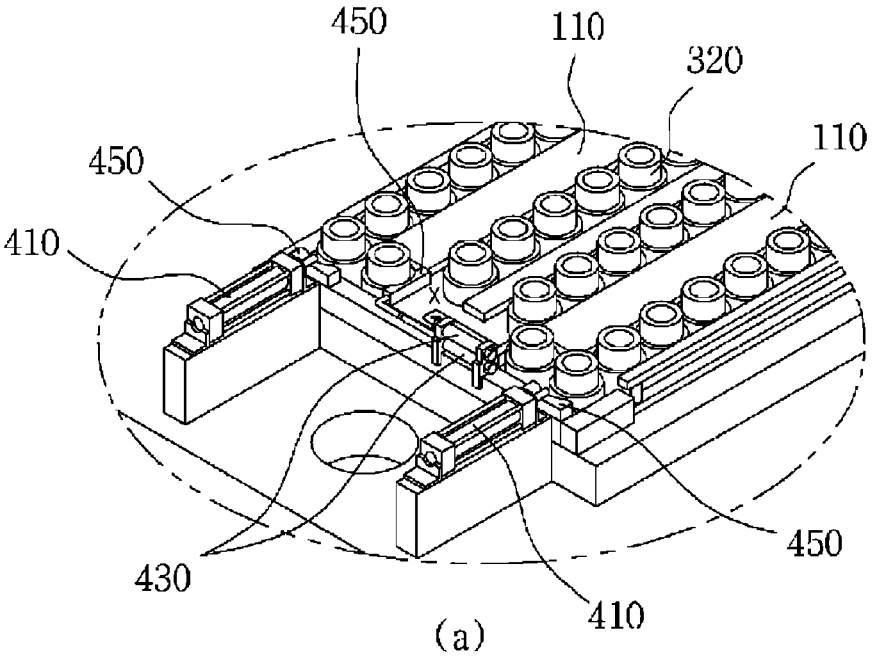
FIG. 8 is a perspective view showing a transfer means of FIG. 3.
Figure 8:
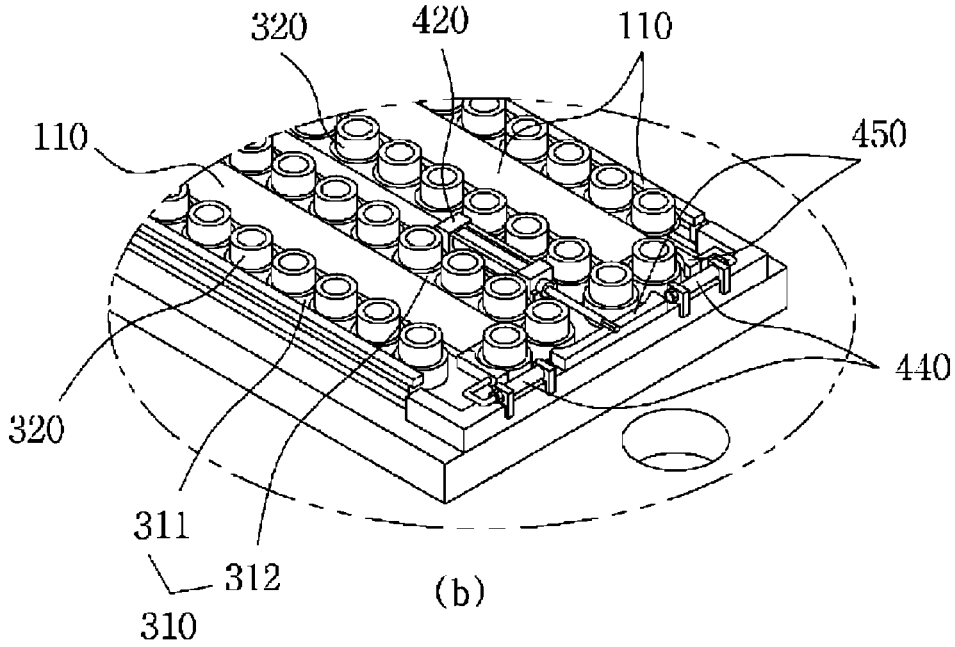
Figure 9:
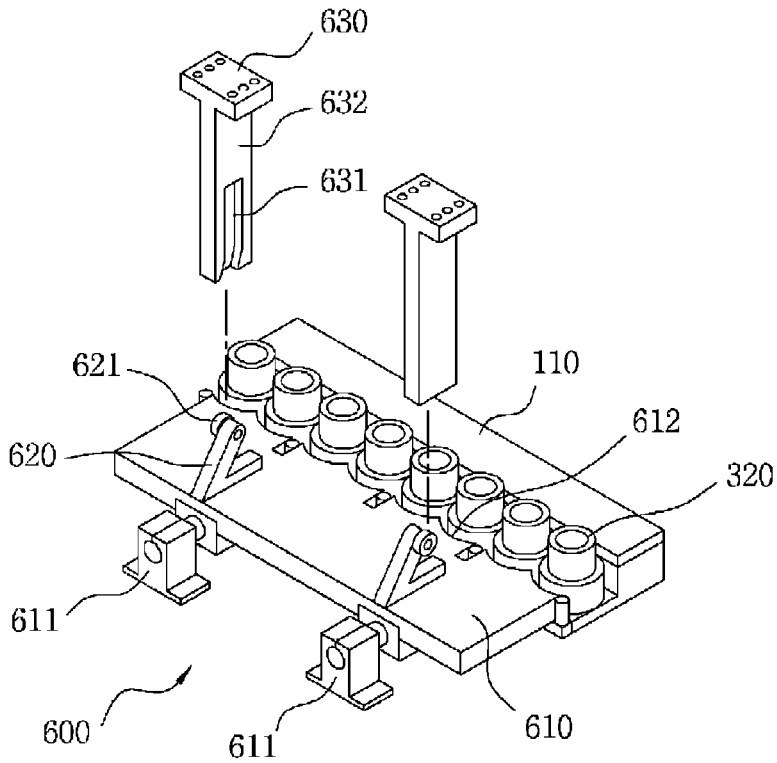
FIG. 9 is a perspective view showing a holder supporting means of FIG. 3.
Figure 9:
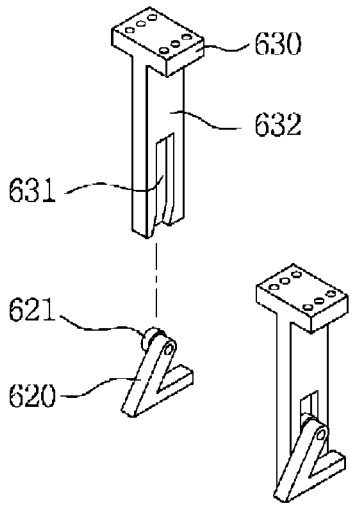
Figure 10:
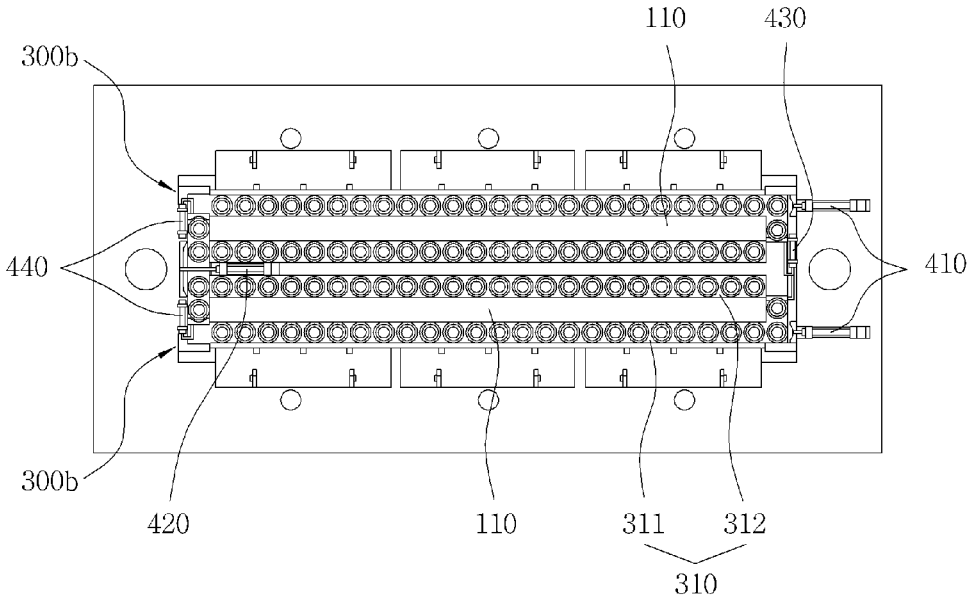
FIG. 10 is a schematic diagram showing a holder circulation structure of the apparatus for manufacturing necking cans in accordance with the present invention.

FIG. 3 is a perspective view showing an apparatus for manufacturing necking cans in accordance with the present invention, FIG. 4 is a side view of FIG. 3, FIG. 5 is a perspective view showing an upper press plate of FIG. 3, FIG. 6 is a perspective view showing a mold pocket of FIG. 3, FIG. 7 is a perspective view showing the installation state of the mold pocket of FIG. 6, FIG. 8 is a perspective view showing a transfer means of FIG. 3, FIG. 9 is a perspective view showing a holder supporting means of FIG. 3, and FIG. 10 is a schematic diagram showing a holder circulation structure of the apparatus for manufacturing necking cans in accordance with the present invention.

As shown in FIGS. 3 to 10, an apparatus A for manufacturing necking cans in accordance with the present invention, which processes the entrance of each can C for which a drawing process is completed, comprises a lower press plate 100, an upper press plate 200 provided to move linearly up and down with respect to the lower press plate 100, a molding unit 300 for gradually reducing an upper entrance of the can C, a transfer means 400 for transferring the can C, and a drive means 500 for driving the upper press plate 200.

First, an upper support 101 is provided on the lower press plate 100. The upper support 101 penetrates the upper press plate 200 to support the up-and-down movement of the upper press plate 200 and prevent the upper press plate 200 from being shaken.

Moreover, the molding unit 300 comprises a guide 310 formed on the lower press plate 100, a plurality of holders 320, into which the cans C are inserted, provided on the guide 310 to be transferred, and a plurality of molds 330 installed on the upper press plate 200 and processing the entrance of each can C.

The guide 310 comprises first and second guides 311 and 312 divided by a guide frame 110 attached to the lower press plate 100, and both ends of the first and second guides 311 and 312 are connected to each other such that the holders 320 circulate. That is, the guide 310 has a rectangular shape.

Meanwhile, the transfer means 400 comprises a first cylinder 410 for transferring the holders 320 along the first guide 311, a second cylinder 420 for transferring the holders 320 along the second guide 312, and third and fourth cylinders 430 and 440 for transferring the holders 320 located at both ends of the first and second guides 311 and 312.

Accordingly, as shown in FIG. 10, the holders 320 into which the cans C are inserted are configured to circulate the guide 310 by the first to fourth cylinders 410, 420, 430 and 440 and subjected to a press process by the molds 330 more than 3 to 20 times. In addition, the holders 320 are linearly transferred by the first to fourth cylinders 410, 420, 430 and 440, thus enabling high-speed processing.

Moreover, a push block 450 including a circular contact portion (not shown) provided in each of the first to fourth cylinders 410, 420, 430 and 440 to partially surround the outer circumference of each holder 320.

The drive means 500 comprises a motor 510 for generating driving force, a drive shaft 520 for transmitting the driving force of the motor 510, a drive cam 530 axially connected to the drive shaft 520, and a driven body 540 interlocked with the driving cam 530 and moving the upper press plate 200 linearly up and down. Here, it is preferred that the driven body 540 should be fixedly mounted on the upper press plate 200.

In addition, the driving force of the motor 510 and the driving shaft 520 is transmitted by a belt pulley 501 and a belt 502.

Moreover, the apparatus A for manufacturing necking cans further comprises a holder supporting means 600 for supporting the holders 320. The holder supporting means 600 comprises a support plate 610 connected to the lower press plate 100 by a horizontal support 611 and moved horizontally toward the holders 320, a holder driven body 620 provided on the support plate 610 and including a bearing 621, and a holder transfer cam 630 fixed on the upper press plate 200 and including a taper groove 631, through which the bearing 621 is inserted, and a straight groove 632.

Furthermore, a semicircular support groove 612 corresponding to the holder 320 is provided on the support plate 610.

Accordingly, when the upper press plate 200 comes down to process the cans C, the support plate 610 moves horizontally to support the side of each holder 320, thus preventing the holders 320 from moving.

In addition to this, when the cans C placed in the holders 320 are processed, the support plate 610 prevents the impact from being applied to the cans C during the processing such that the cans C can be stably processed.

Moreover, the apparatus A for manufacturing necking cans further comprises a mold pocket 700 in which the molds 330 are provided. The mold pocket 700 is mounted on the upper press plate 200 by a mold pocket pin 710. Here, the mold pocket 700 may be connected to the upper press plate 200 by sliding or by screw fastening.

Further, the plurality of molds 330 are provided in the mold pocket 700 to eliminate the inconvenience of replacing the molds 330 one by one.

That is, unlike the conventional apparatus 10 for manufacturing necking cans, in which the molds 13 are replaced one by one, the mold pocket 700 in which the plurality of molds 330 are provided can be replaced to reduce the replacement time, thus improving the productivity.

Moreover, each mold 330 comprises an outer mold 331 and an inner mold 332 and, after the height of the mold 330 is adjusted by means of height adjusting nut and bolt 333 and 334, the mold 330 is mounted in the mold pocket 700.

Meanwhile, the plurality of molds 330 are known in the art and used in the neck-in processing, and thus detailed description thereof will be omitted.

Further, the molding unit 300 comprises first and second molding units 300*a* and 300*b* to separately process the cans C for which the drawing process is completed. That is, the first and second molding units 300*a* and 300*b* are provided at both ends with respect to the center of the upper and lower press plates 100 and 200.

Accordingly, the first and second molding units 300*a* and 300*b* can separately process the cans C at high speed, which ensures high productivity. Moreover, two types of products can be manufactured by a single equipment by separately mounting molds 330 having different sizes on the first and second molding units 300*a* and 300*b* as occasion demands, thus maximizing the efficiency of managing the equipment. That is, it is possible to manufacture cans C having different sizes at the same time.

The preferred embodiments of the invention have been described in detail as above. However, it will be appreciated by those skilled in the art that various changes and modification may be made in these embodiments without departing from the principles and spirit of the invention, the scope of which is defined in the appended claims and their equivalents.

The invention claimed is:

1. An apparatus for manufacturing necking cans, which processes the entrance of each can for which a drawing process is completed, the apparatus comprising:

a lower press plate;

an upper press plate provided to move linearly up and down with respect to the lower press plate;

a molding unit including a guide formed on the lower press plate, a plurality of holders provided on the guide to be transferred, and a plurality of molds provided on the upper press plate;

a transfer means for transferring the holders along the guide;

a drive means for driving the upper press plate; and a holder supporting means for supporting the holders, wherein the holder supporting means comprises a support plate connected to the lower press plate by a horizontal support and moved horizontally toward the holders, a holder driven body provided on the support plate and including a bearing, and a holder transfer cam fixed on the upper press plate and including a taper groove, through which the bearing is inserted, and a straight groove.

2. The apparatus of claim 1, wherein the guide comprises first and second guides divided by a guide frame attached to the lower press plate, both ends of the first and second guides being connected to each other such that the holders circulate.

3. The apparatus of claim 2, wherein the transfer means comprises a first cylinder for transferring the holders along the first guide, a second cylinder for transferring the holders along the second guide, and third and fourth cylinders for transferring the holders located at both ends of the first and second guides.

4. The apparatus of claim 3, wherein each of the first to fourth cylinders comprises a push block.

5. The apparatus of claim 1, wherein the drive means comprises a motor for generating driving force, a drive shaft for transmitting the driving force of the motor, a drive cam axially connected to the drive shaft, and a driven body for moving the upper press plate linearly up and down in conjunction with the drive cam.

6. The apparatus of claim 1, wherein the support plate comprises a semicircular support groove corresponding to the holder.

7. The apparatus of claim 1, further comprising a mold pocket, in which the molds are provided, the mold pocket being mounted on the upper press plate by a mold pocket pin.

8. The apparatus of claim 7, wherein the mold comprises an outer mold and an inner mold, the molding being mounted in the mold pocket by height adjusting nut and bolt.

9. The apparatus of claim 1, wherein the molding unit comprises first and second molding units to separately process the cans for which the drawing process is completed.

* * * * *